US008025349B2

(12) United States Patent
Lim et al.

(10) Patent No.: US 8,025,349 B2
(45) Date of Patent: Sep. 27, 2011

(54) REFRIGERATOR WITH DOOR OPENING DEVICE

(75) Inventors: Jae Hoon Lim, Suwon-si (KR); Jae Myung Han, Gwangju (KR); Jong Eon Si, Gwangju (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 207 days.

(21) Appl. No.: 12/320,833

(22) Filed: Feb. 5, 2009

(65) Prior Publication Data

US 2009/0205357 A1 Aug. 20, 2009

(30) Foreign Application Priority Data

Feb. 20, 2008 (KR) ..... 10-2008-0015439

(51) Int. Cl.
*A47B 96/04* (2006.01)

(52) U.S. Cl. ..... 312/405; 312/319.2; 312/332.1; 16/412

(58) Field of Classification Search ..... 312/404, 312/405, 405.1, 402, 332.1; 49/489.1, 492.1, 49/498.1, 493.1; 62/265, 449, 440; 16/412
See application file for complete search history.

(56) References Cited

U.S. PATENT DOCUMENTS

| | | | | |
|---|---|---|---|---|
| 2,659,115 | A * | 11/1953 | Anderson et al. | 49/277 |
| 2,889,787 | A * | 6/1959 | Schell | 109/63.5 |
| 5,906,423 | A * | 5/1999 | Lyu | 312/405 |
| 5,908,228 | A * | 6/1999 | Lee | 312/405 |
| 5,915,805 | A * | 6/1999 | Lee | 312/405 |
| 6,375,291 | B1 * | 4/2002 | Nam et al. | 312/405 |
| 6,655,765 | B2 * | 12/2003 | Kawamura et al. | 312/405 |
| 6,997,527 | B2 * | 2/2006 | Cheng | 312/332.1 |
| 7,104,621 | B2 * | 9/2006 | Choi | 312/405 |
| 7,195,293 | B2 * | 3/2007 | Ala | 292/254 |
| 2006/0043852 | A1 * | 3/2006 | Kwon | 312/405 |
| 2006/0103278 | A1 * | 5/2006 | Bousquet | 312/332.1 |
| 2008/0000052 | A1 * | 1/2008 | Hong et al. | 16/382 |

FOREIGN PATENT DOCUMENTS

| | | | |
|---|---|---|---|
| EP | 1174668 | * | 1/2002 |
| EP | 1175668 | * | 1/2002 |
| KR | 10-2001-0072250 | | 7/2001 |

* cited by examiner

*Primary Examiner* — Hanh V Tran
(74) *Attorney, Agent, or Firm* — Staas & Halsey LLP

(57) ABSTRACT

A refrigerator allowing a user to easily open a door of a refrigerator with less force, including a main body having an upper storage compartment and a lower storage compartment, a door sliding to open and close any of the storage compartments, a handle vertically rotatable relative to the door, a plurality of push members moving to advanced positions from retreated positions by the vertical rotation of the handle to separate the door from the main body, and an elastic member between at least one of the push members and the door to restore the push members to the retreated positions when an external force is removed from the handle.

11 Claims, 7 Drawing Sheets

REFRIGERATOR WITH DOOR OPENING DEVICE

CROSS-REFERENCE TO RELATED APPLICATIONS

This application claims the benefit of Korean Patent Application No. 2008-0015439, filed on Feb. 20, 2008 in the Korean Intellectual Property Office, the disclosure of which is incorporated herein by reference.

BACKGROUND

1. Field

The present invention relates to a refrigerator, and, more particularly, to a refrigerator having a door opening device which allows a user to easily open a door of the refrigerator.

2. Description of the Related Art

A refrigerator is an apparatus which freshly stores food in a freezing or cooling compartment for a long period of time, where a chiller room is separately provided at the rear of the freezing compartment, an evaporator is disposed in the chiller room, cool air generated in the evaporator according to operation of a compressor is compulsorily supplied into the freezing compartment or the cooling compartment, and warm air having an increased temperature is made to return to the chiller room, thereby freezing or cooling the inside of the freezing compartment or the cooling compartment.

When the door of the refrigerator is opened for a specific period of time and then closed in order to store or take goods in or out of the refrigerator, a large amount of humid and hot air existing outside the refrigerator quickly flows into the refrigerator.

The outside air which has flowed into the refrigerator is quickly cooled at a low temperature inside the refrigerator, and the volume of the air is contracted. Accordingly, the inside of the refrigerator Is maintained at an air pressure (hereinafter, referred to as a "negative pressure") which is slightly lower than an atmospheric pressure outside the refrigerator for a certain period of time.

Accordingly, if the door of the refrigerator is intended to be opened in a state where the negative pressure is generated in the refrigerator, the negative pressure should be compulsorily removed to open the door of the refrigerator.

In order to solve the above-mentioned problem, Korean Patent Laid-open Publication No. 10-2001-72250 discloses a refrigerator having a lever handle for a door, which allows a user to open the door with a small force.

The refrigerator disclosed in the Publication includes a heating insulating housing with an open front surface; a drawer type door which covers a front opening of the heating insulating housing; a pivotal support handle which is connected to the drawer type door for movement between opened and closed positions to open and close the drawer type door; a trigger member which is coupled to the handle to interwork with the handle for movement between advanced and retreated positions and is engaged with an edge of the opening of the heating insulating housing. The trigger member includes a pressing surface, which is formed as a single body with the trigger member and presses the trigger member to its advanced position from its retreated position according to the movement of the handle from its closed position to its opened position, and a drawing surface, which is formed as a single body with the trigger member and returns the trigger member to its retreated position from its advanced position according to the movement of the handle from its opened position to its closed position. When the handle is maintained at its closed position, the trigger member is spaced from the contact surface of the edge of the opening of the heating insulating housing by a specific distance.

Accordingly, the trigger member advances and retreats in connection with the rotation of the handle. The trigger member should be pushed or pulled by forming a pressing surface and a drawing surface on the handle.

In the above-mentioned conventional refrigerator, one end of the trigger member should be disposed between the pressing surface and the drawing surface formed at an end portion of the handle. The end portion of the handle may be separated between the pressing surface and the drawing surface due to reduction of durability as the door is frequently opened and closed, thereby causing a breakdown.

Further, in the conventional refrigerator, since a single trigger member is disposed at a portion opposite to a hinge portion of the door hinge-coupled to the refrigerator or an upper portion of the drawer type door which is slidably opened and closed, there is a problem that the door is not smoothly opened.

Particularly, In a so-called French type refrigerator, where the cooling compartment and the freezing compartment are disposed on the upper and lower sides, the door capable of being opened and closed laterally is disposed on the cooling compartment of the upper side, and a drawer type door is disposed on the freezing compartment of the lower side, and the width of the cooling compartment and the freezing compartment is larger than that of a general refrigerator. Accordingly, if the user opens the door of the freezing compartment, the user should exert a large force on the door due to the weight of the door and the weight of goods stored in the drawer.

In a case where a single trigger member disclosed in the Publication is used for the door of the freezing compartment of the French type refrigerator, there is a problem that it Is difficult to easily open and close the door.

SUMMARY

The present embodiments have been made in order to solve the above problems. It is an aspect of the embodiments to provide a refrigerator capable of improving durability of an easily opened door.

It is another aspect of the embodiments to provide a refrigerator which allows the user to easily open the door with a small force.

Additional aspects and/or advantages will be set forth in part in the description which follows and, in part, will be obvious from the description, or may be learned by practice of the invention.

The foregoing and/or other aspects are achieved by providing a refrigerator, including: a main body having an upper storage compartment and a lower storage compartment defined on upper and lower sides; a sliding door slides opening and closing any one of the storage compartments; a handle disposed at an upper portion of the door to be vertically rotatable; a plurality of push members connected between the door and the handle moving to advanced positions from retreated positions in connection with a vertical rotation of the handle to separate the door from the main body; and an elastic member disposed between at least one of the push members and the door to restore the push members to the retreated positions when an external force is removed from the handle.

The elastic member may be formed as a coil spring.

A step portion may be formed on an upper surface of the sliding door to support one end of the elastic member.

The step portion may have a guide which is inserted into the coil spring to guide smooth contraction and restoration of the coil spring.

The refrigerator may further include a stopper to prevent the coil spring from being separated from the guide.

At least one of the push members may include a receiving portion receiving and supporting an other end of the elastic member.

The handle may include a plurality of pressing portions moving the push members to the advanced positions and a grip rod connecting the pressing portions to each other.

A rotation shaft may be formed on the handle as a single body to vertically rotate the handle.

The refrigerator may further include a rotation shaft to rotate the handle, the handle being inserted and coupled to the rotation shaft.

The handle may be rotated to an upward position to move the push members to the advanced positions, and the handle may be rotated to a downward position due to the weight of the handle when an external force is removed from the handle.

The handle may be formed to have a length corresponding to a width of the door.

At least one anti-separation piece may be attachably and detachably provided to fix the rotation shaft.

The foregoing and/or other aspects are achieved by providing a refrigerator, including: a main body having a storage compartment; a door opening and closing the storage compartment; a handle horizontally disposed at an upper portion of the door and vertically rotatable with respect to the door; and a pair of push members disposed at an upper boundary of the door corresponding to opposite ends of the handle and movable forward and backward to separate the door from the main body, the pair of the push members pressing a border of the main body in connection with an upward rotation of the handle to separate the door from the main body, wherein the handle is rotated downward and restored due to the weight of the handle after the upward rotation of the handle.

The storage compartment may include an upper storage compartment and a lower storage compartment defined on upper and lower sides, and the door is a drawer-type door which slides to open and close the lower storage compartment.

The refrigerator further may include an elastic member disposed between at least one of the push members and the door to restore the at least one push member to a state in which the at least one push member is spaced from the border by a specific distance.

A step portion may be formed on an upper surface of the door to support one end of the elastic member, and at least one of the push members may include a receiving portion receiving and supporting an other end of the elastic member.

A guide may be disposed between the step portion and the receiving portion to guide smooth contraction and restoration of the elastic member.

The refrigerator may further include a stopper disposed between the elastic member and the push member to prevent the elastic member from being separated from the guide.

The handle may include a pair of pressing portions moving the push members to advanced positions.

A rotation shaft may be formed on the handle as a single body to vertically rotate the handle.

The refrigerator may further include a rotation shaft to rotate the handle, the handle being inserted and coupled to the rotation shaft.

The foregoing and/or other aspects are achieved by providing a refrigerator, including: a main body having a storage compartment; a door opening and closing the storage compartment; a handle horizontally disposed at an upper portion of the door and installed to be vertically rotatable with respect to the door; a pair of push members disposed at a boundary of the door to be movable forward and backward; and elastic members disposed between the pair of the push members and the door to provide an elastic force, the push members advancing in connection with a rotation of the handle to separate the door from the main body when the handle is rotated upward by an external force, the handle being rotated downward and restored due to weight of the handle when the external force is removed, and the push members being restored to retreated positions separated from the boundary by a specific distance by the elastic members.

The foregoing and/or other aspects are achieved by providing a refrigerator, including: a main body storing foods to be cooled; a door proximate to the main body; a rotatable handle horizontally attached to the door to separate the door from the main body; and a plurality of push members engaged by the rotatable handle and engagable with a portion of the main body when the rotatable handle is rotated to separate the door from the main body.

The rotatable handle may include a plurality of pressing portions each engaged with one of the push members and causing the push members to move from a first position in which the push member is not engaged with the main body to a second position in which the push member is engaged with the main body.

The refrigerator may include a plurality of guides disposed between each of the push members and a portion of the door and a plurality of elastic members each retained between each of the push members and each of the guides to cause the push members to move between the first position and the second position.

As described above, the refrigerator according to the present embodiments is configured to advance the push members using the handle and to retreat the push members using the elastic members. Accordingly, there is an effect of reducing generation of a breakdown of an easily opened door even though it is used for a long period of time.

Further, according to the present embodiments, a plurality of the push members are provided and driven in the rotation of the handle. Accordingly, there is an effect of smoothly opening and closing the heavy door with a smaller force compared to the conventional technology.

BRIEF DESCRIPTION OF THE DRAWINGS

These and/or other aspects and advantages of the embodiments will become apparent and more readily appreciated from the following description of the embodiments, taken in conjunction with the accompanying drawings, of which.

DETAILED DESCRIPTION OF EMBODIMENTS

Figure 1:
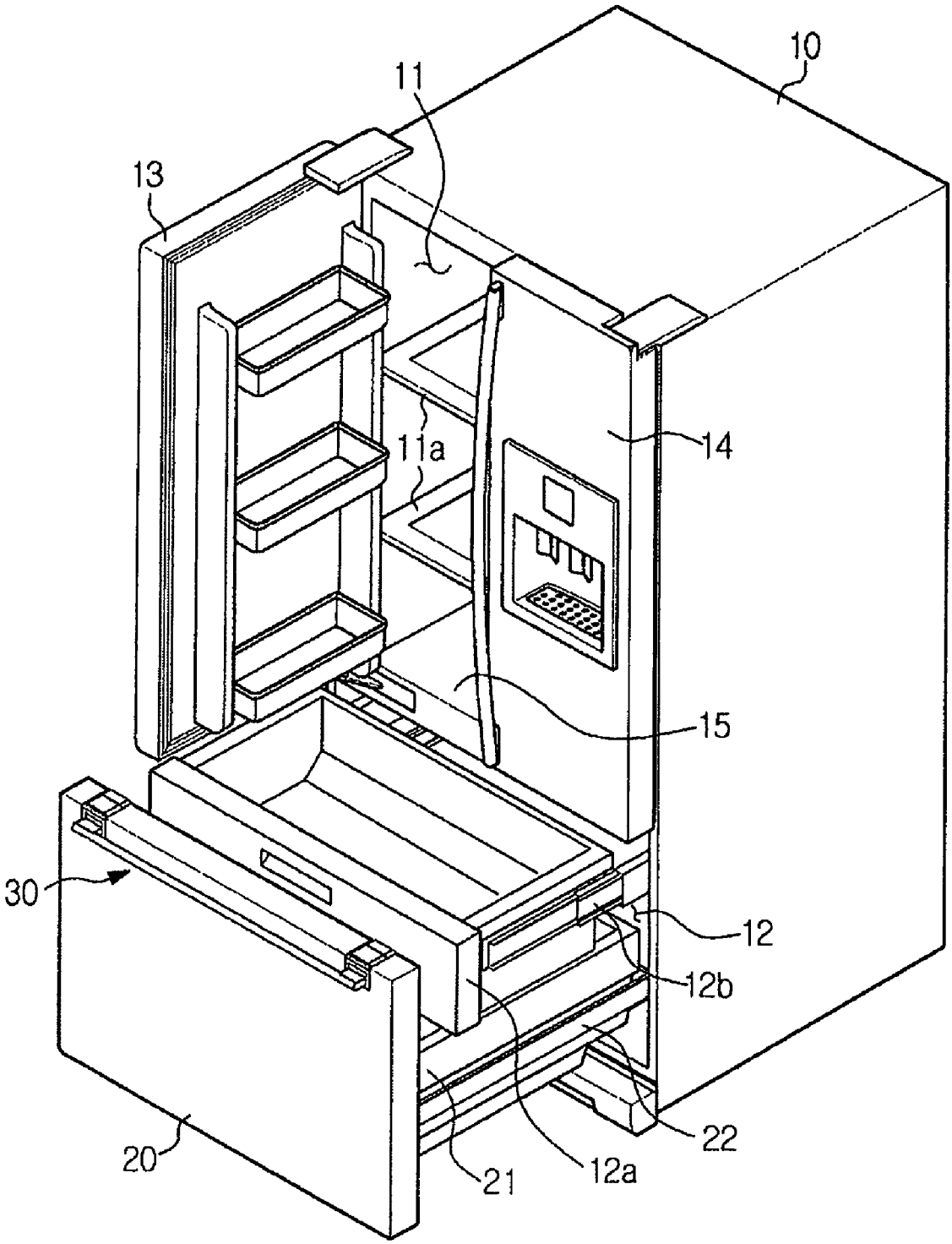
FIG. 1 illustrates a perspective view showing a refrigerator according to a first embodiment.

Reference will now be made in detail to the embodiments, examples of which are illustrated in the accompanying drawings, wherein like reference numerals refer to like elements throughout. The embodiments are described below to explain the present invention by referring to the figures.

Hereinafter, a refrigerator according to a first embodiment will be described in detail with reference to the accompanying drawings.

Figure 2:
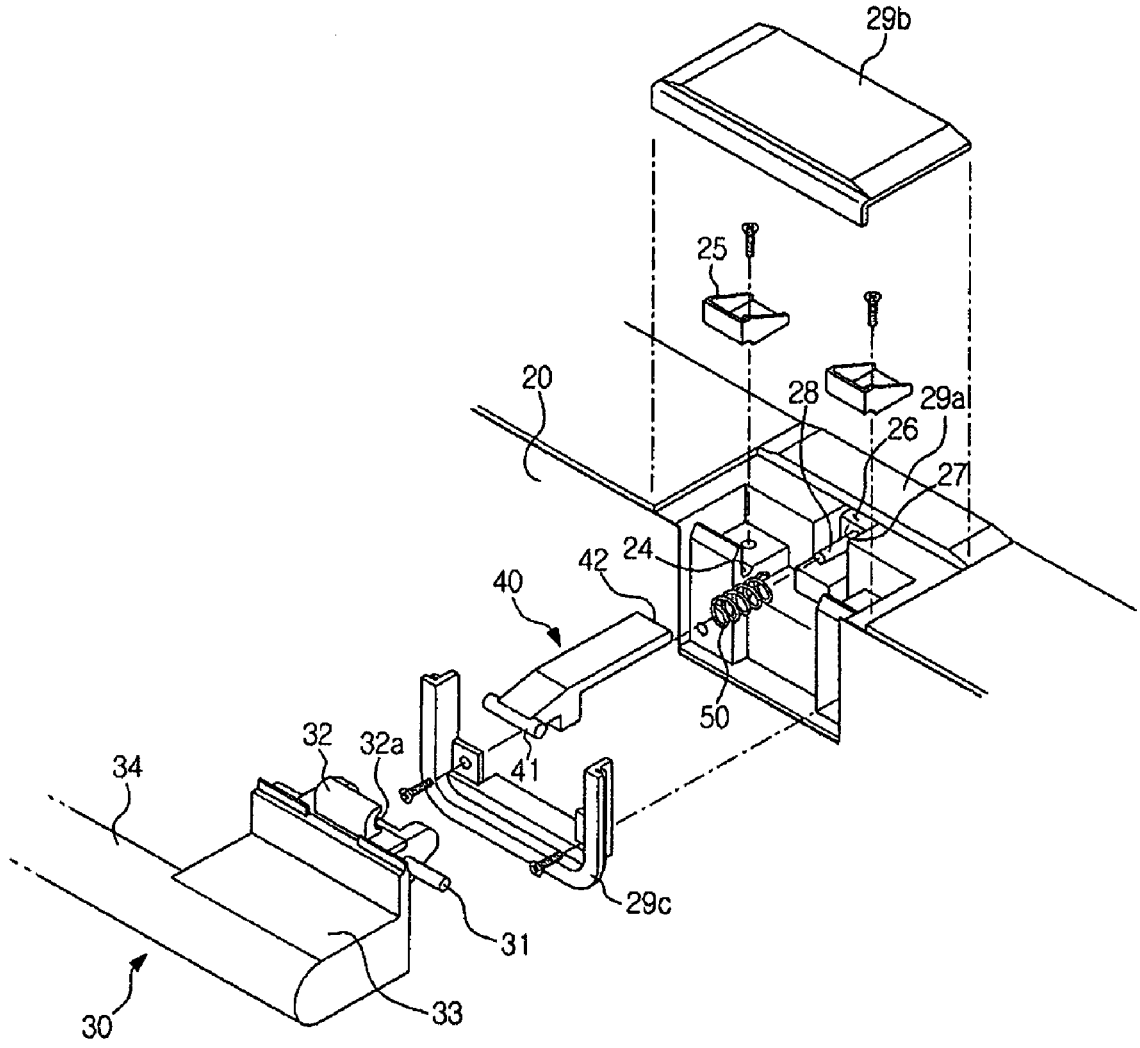
FIG. 2 illustrates an exploded perspective view showing a door and a handle of the refrigerator according to the first embodiment.
Figure 3:
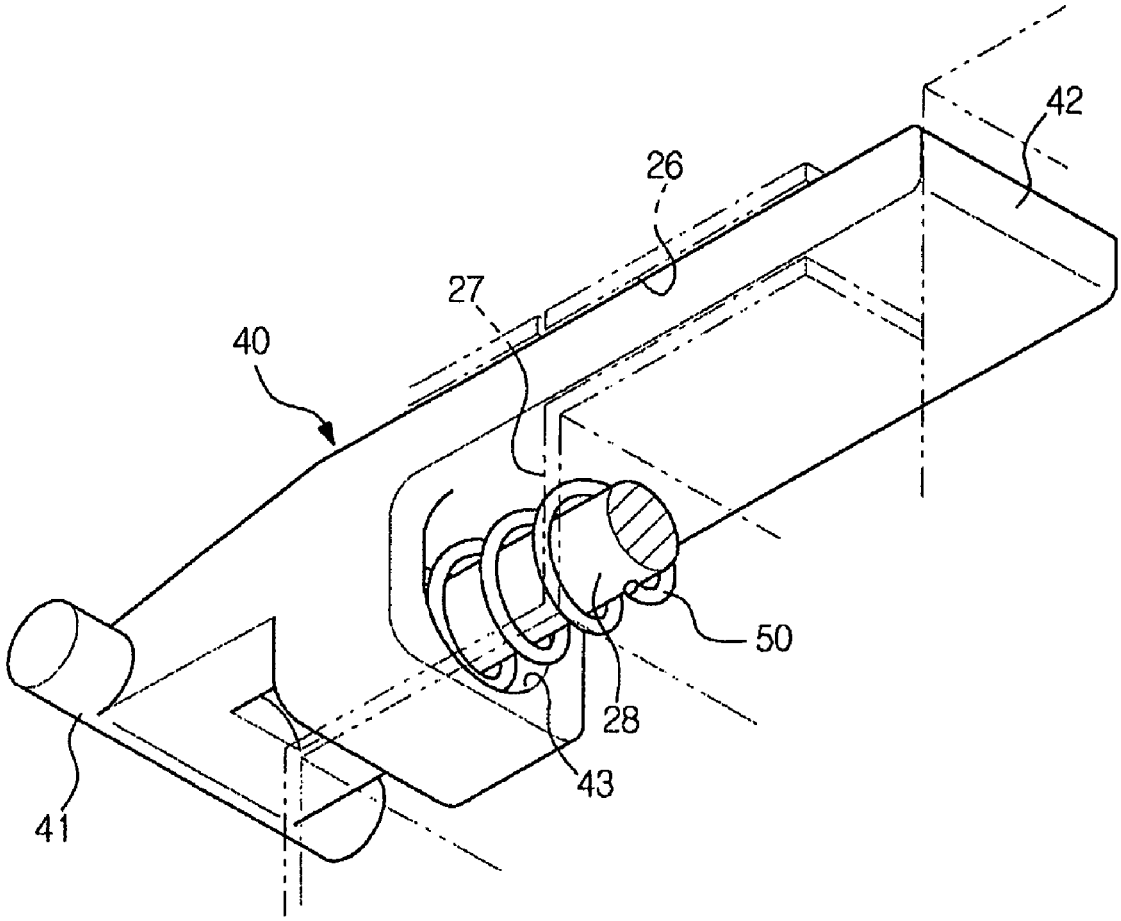
FIG. 3 illustrates a perspective view showing a coupling relation of a push member and an elastic member of the refrigerator according to the first embodiment.
Figure 4:
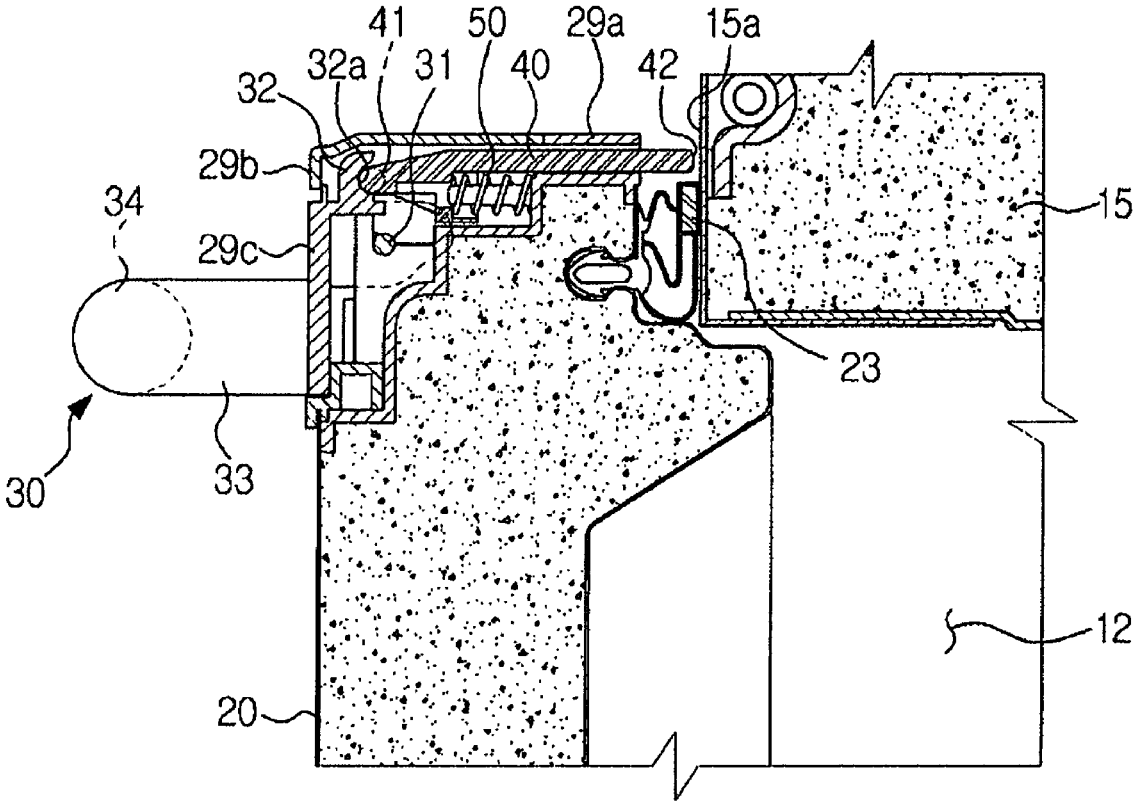
FIG. 4 illustrates a cross-sectional view of essential parts showing a closed state of the door of the refrigerator according to the first embodiment.
Figure 5:
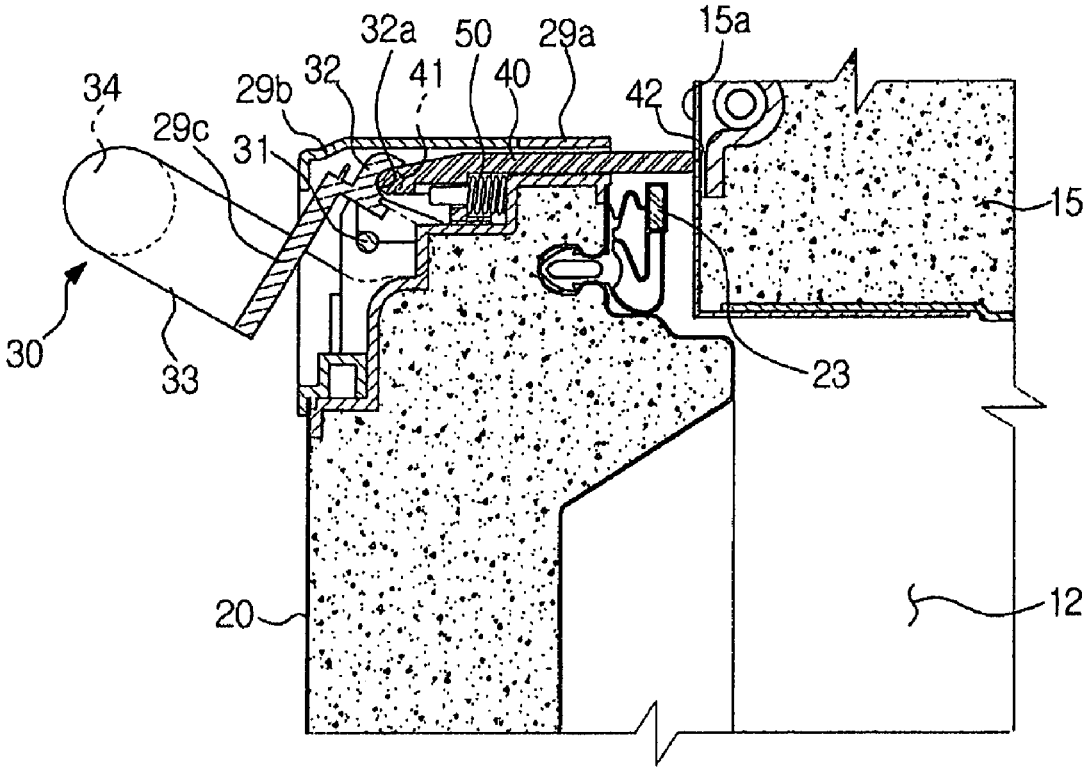
FIG. 5 illustrates a cross-sectional view of essential parts showing an opening operation of the door of the refrigerator according to the first embodiment.

FIG. 1 illustrates a perspective view showing the refrigerator according to the first embodiment. FIG. 2 illustrates an exploded perspective view showing a door and a handle of the refrigerator according to the first embodiment. FIG. 3 illustrates a perspective view showing a coupling relation of a push member and an elastic member of the refrigerator according to the first embodiment. Further, FIG. 4 illustrates a cross-sectional view of essential parts showing a closed state of the door of the refrigerator according to the first embodiment. FIG. 5 illustrates a cross-sectional view of essential parts showing an opening operation of the door of the refrigerator according to the first embodiment.

As shown in FIG. 1, the refrigerator according to the first embodiment includes a main body 10 having upper and lower storage compartments 11 and 12 defined on the upper and lower sides by a heat insulating partition wall 15, and doors 13, 14 and 20 which are disposed on the front surfaces of the upper and lower storage compartments 11 and 12 to open and close the storage compartments 11 and 12.

The refrigerator according to the present embodiment may include a compressor (not shown), condenser (not shown), an expander (not shown) and an evaporator (not shown) and the like to form a refrigeration cycle as in a general refrigerator.

The storage compartments 11 and 12 defined by the heat insulating partition wall 15 include the upper storage compartment 11 located on the upper side and the lower storage compartment 12 located on the lower side. The upper storage compartment may be set as a cooling compartment and the lower storage compartment may be set as a freezing compartment. Of course, each of the storage compartments may be variably used as a cooling compartment or a freezing compartment.

The refrigerator according to the present embodiment is a so-called French type refrigerator, which is an example of a bottom mounted freezer (BMF) in which the lower storage compartment 12 is set as a freezing compartment and the upper storage compartment 11 is set as a cooling compartment. The storage compartments of the refrigerator according to the present embodiments have a relatively large width than those of a side-by-side (SBS) refrigerator, a general BMF and a top mounted freezer (TMF) in order to accommodate stored goods, such as a pizza, having a relatively large width.

Shelves 11*a* may be installed to be spaced from each other by a specific distance in the upper storage compartment 11 to store food in a cooled state. A receiving basket 12*a* is slidably installed in an upper area of the lower storage compartment 12 to store food in a frozen state.

If a single door capable of rotating laterally is disposed on the upper storage compartment having a large width in the French type refrigerator, a large amount of cool air is discharged from the upper storage compartment when the door is opened. Since the door has a large size, the user would have to exert a large force on the door to open and close the door.

Accordingly, a pair of first and second doors 13 and 14 capable of rotating laterally are disposed on the upper storage compartment in order to relieve the above problem.

Since the door disposed on the lower storage compartment is formed as a drawer type door which is slidably opened and closed, a receiving drawer, which is formed as a single body with the door, is extracted when the door is opened.

If a plurality of doors such as first and second doors of the upper storage compartment are installed on the lower storage compartment and receiving drawers are respectively installed on the doors, stored goods having a relatively large size cannot be stored therein. Accordingly, a single third door 20 with a single receiving drawer formed on the rear surface thereof is disposed on the lower storage compartment to open and close the lower storage compartment 12.

Since the single third door 20 is disposed on the lower storage compartment 12, a larger force is required to open the door of the lower storage compartment 12 than to open the first and second doors 13 and 14 of the upper storage compartment 11 due to a magnetic force of a gasket disposed at a boundary of the rear surface of the door 20, a weight of the door and the receiving drawer, a weight of goods stored in the receiving drawer, a pressure difference between the inside and the outside of the lower storage compartment and the like.

In order to solve this problem, the refrigerator according to the present embodiment includes a door structure capable of easily opening the third door 20 which opens and closes the lower storage compartment 12.

As shown in FIGS. 1 and 2, the refrigerator according to the present embodiment includes the third door 20 which slidably opens and closes the lower storage compartment 12, a handle 30 capable of rotating vertically which is horizontally disposed at an upper portion of the third door 20, and a plurality of push members 40 which move to advanced positions from retreated positions as the handle 30 is rotated upward to separate the third door 20 from the main body 10.

The receiving basket 12*a*, which receives stored goods, and first sliding rails 12*b*, which are connected to opposite side surfaces of the receiving basket 12*a* to slidably extract and retract the receiving basket 12*a*, are provided at an upper portion of the lower storage compartment 12.

A drawer 21 adapted to receive the stored goods is formed on the rear surface of the third door 20 as a single body with the door 20 to be slidable according to forward and backward movement of the third door 20. A gasket 23 (see FIG. 4) is disposed along a periphery at the boundary of the rear surface of the third door 20 and has a magnet to improve a sealing force, thereby preventing cool air from leaking out of the lower storage compartment 12.

Second sliding rails 22 are disposed on opposite side surfaces of the drawer 21 to guide the drawer 21 such that the third door 20 can smoothly slide.

The handle 30 is formed at a front upper portion of the third door 20 such that the user can grip the handle 30 to move the third door 20 forward and backward.

The handle 30 includes rotation shafts 31 provided to rotate the handle 30 upward, a pair of pressing portions 32 which is extended upward from the rotation shafts 31 to move a pair of the push members 40 to advanced positions, a pair of levers 33 which is extended forward from the rotation shafts 31, and a grip rod 34 which connects a pair of the levers 33 to each other.

The handle 30 is disposed at an upper boundary of the third door 20 to be substantially parallel thereto.

Seating grooves 24 are formed on the upper surface of the third door 20 corresponding to the rotation shafts 31. Anti-separation pieces 25 are coupled to the seating grooves 24 to cover the rotation shafts 31, thereby firmly fixing the rotation shafts 31.

The pressing portions 32 are rotated (clockwise in the drawing) as the levers 33 are rotated upward, thereby advancing the push members 40. The pressing portions 32 have arc-shaped pressing surfaces 32*a* at portions in contact with the push members 40. The pressing portions 32 press end portions of the push members 40 to advance the push members 40.

The grip rod 34 is formed corresponding to the width of the third door 20 to have a length substantially equal to or slightly smaller than the width of the third door 20 such that the user can easily grip the grip rod 34.

A pair of the levers 33 is formed at opposite ends of the grip rod 34. When the user rotates the grip rod 34 upward, a pair of the levers 33 formed as a single body with the grip rod 34 are rotated around the rotation shafts 31 and, then the pressing portions 32 press the push members 40.

Further, when the user releases the grip rod 34, that is, when an external force exerted on the handle 30 is removed, the handle 30 is rotated downward around the rotation shafts 31 due to the weight of the grip rod 34 and the levers 33. Accordingly, the handle 30 is restored to its original state.

The push members 40 are slidably disposed on the upper surface of the third door 20. The push members 40 press a border of the main body 10, that is, a front surface 15*a* of the heat insulating partition wall 15 to separate the third door 20 from the main body 10. The push members 40 include arc-shaped first contact portions 41 formed at one end thereof corresponding to the pressing surfaces 32*a* of the pressing portions 32, and second contact portions 42 at the other end thereof to transfer a pressing force of the pressing portions 32 to the main body 10.

Grooves 26 are formed on the upper surface of the third door 20 to be recessed corresponding to the second contact portions 42 such that the second contact portions 42 can slide.

Further, elastic members 50 are disposed between the push members 40 and the third door 20 to provide an elastic force to the push members 40 such that the second contact portions 42 of the push members 40 can be restored to a state in which the second contact portions 42 are spaced from the main body 10.

The elastic members 50 may be formed in a coil spring shape and are arranged in a space between the push members 40 and the third door 20. Step portions 27 are formed on the third door 20 to have vertical surfaces bent downward from the grooves 26 to support one end of the elastic members 50. As shown in FIG. 3, receiving portions 43 are formed on the push members 40 to support the other end of the elastic members 50 and the push members 40 include edge portions 44 (FIG. 7) extending down through which the receiving portions 43 are defined.

The receiving portions 43 have a specific depth and a diameter larger than the diameter of the elastic members 50 to receive certain portions of the elastic members 50.

Further, guides 28 are protrudingly formed on the step portions 27 to guide smooth contraction and restoration of the elastic members 50.

Accordingly, one end of the elastic members 50 is supported by the step portions 27 and the other end of the elastic members 50 is supported by the receiving portions 43 of the push members 40. Since the guides 28 are inserted into the elastic members 50 to guide the movement of the elastic members 50, it is possible to prevent nonuniform contraction and restoration of the elastic members 50.

First covers 29*a*, which close upper portions of the grooves 26 in which the second contact portions 42 are advanced and retreated to enhance the beauty of an external appearance, and second covers 29*b*, which close assembly portions of the push members 40, the elastic members 50 and the handle 30, are disposed on the upper surface of the third door 20.

Front covers 29*c* are disposed between the third door 20 and the handle 30 to enhance the beauty of the external appearance and absorb an impact in the rotation of the handle 30.

Accordingly, in the refrigerator according to the present embodiment, in a case of opening the lower storage compartment 12, when the user moves the grip rod 34 upward to rotate the handle 30 around the rotation shafts 31, the pressing surfaces 32*a* of the pressing portions 32 press the first contact portions 41 of the push members 40. In this case, a pair of the push members 40 slide and advance toward the main body 10. The second contact portions 42 of the push members 40 press the border of the main body 10, that is, the front surface 15*a* of the heat insulating partition wall 15.

The third door 20 is spaced from the main body 10 by a specific distance due to the pressing force. Accordingly, it is possible to achieve pressure equilibrium between the inside and the outside of the lower storage compartment 12 and also possible to weaken a coupling force between the third door 20 and the main body 10 due to the magnetic force of the gasket 23, thereby easily sliding and opening the third door 20.

Thus, in a case of opening the heavy third door 20 of the lower storage compartment 12, as the user rotates the grip rod 34 upward, a plurality of the push members 40 press the main body 10. Accordingly, the user can easily open the third door 20 with a small force.

Thereafter, when the user releases the grip rod 34, that is, when an external force exerted on the handle 30 is removed, the handle 30 is rotated downward around the rotation shafts 31 due to the weight of the grip rod 34 and the levers 33. Accordingly, the handle 30 is restored to its original state. Since the pressing portions 32 which press the push members 40 are rotated (counterclockwise in the drawing) and a force exerted on the push members 40 by the pressing portions 32 is removed, the handle 30 is rotated downward and, at the same time, the push members 40 slide to the retreated positions by an elastic restoration force of the elastic members 50 disposed between the push members 40 and the third door 20.

Accordingly, the handle 30 is rotated downward due to its weight. In this case, the handle 30 does not retreat the push members 40, and the elastic members 50 are additionally provided to restore the push members 40. That is, in the present embodiment, it is possible to omit a structure in which the handle retreats the push members, which is used in the conventional case. As a result, it is possible to improve durability by simplifying a coupling structure of the handle and the push members.

Although the refrigerator according to the first embodiment includes the elastic members between the push members and the door, the elastic members may be omitted between the push members and the door.

In a case of omitting the elastic members, the operation is described below.

When the third door 20 is opened to open the lower storage compartment 12, in the same way as in the first embodiment, the user moves the grip rod 34 upward to rotate the handle 30 around the rotation shafts 31. Accordingly, the pressing surfaces 32*a* of the pressing portions 32 press the first contact portions 41 of the push members 40. In this case, the push members 40 slide and advance toward the main body 10. The second contact portions 42 of the push members 40 press the border of the main body 10, that is, the front surface 15*a* of the heat insulating partition wall 15.

Thereafter, when the user releases the grip rod 34, that is, when an external force exerted on the handle 30 is removed, the handle 30 is rotated downward around the rotation shafts 31 due to the weight of the grip rod 34 and the levers 33. Accordingly, the handle 30 is restored to its original state. In this case, since the elastic members are omitted, the push members 40 are not restored to their retreated positions and remain at their advanced positions. That is, the pressing surfaces 32*a* of the pressing portions 32 and the first contact portions 41 of the push members 40 are maintained in a separated state.

Then, in a case of closing the third door 20, the second contact portions 42 of the push members 40 are pressed by the front surface 15*a* of the heat insulating partition wall 15, and the push members 40 slide and move to the retreated positions. Accordingly, the pressing surfaces 32*a* of the pressing portions 32 and the first contact portions 41 of the push members 40 are restored to be in contact with or adjacent to each other. That is, the pressing surfaces 32*a* of the pressing portions 32 and the first contact portions 41 of the push members 40 are restored to a state in which the pressing surfaces 32*a* of the pressing portions 32 can press the first contact portions 41 of the push members 40 as described above when the lower storage compartment 12 is opened.

Next, a refrigerator according to a second embodiment will be described.

The same reference numerals are assigned to parts having the same configuration as in the first embodiment of the present invention, and the description thereof is omitted.

Figure 6:
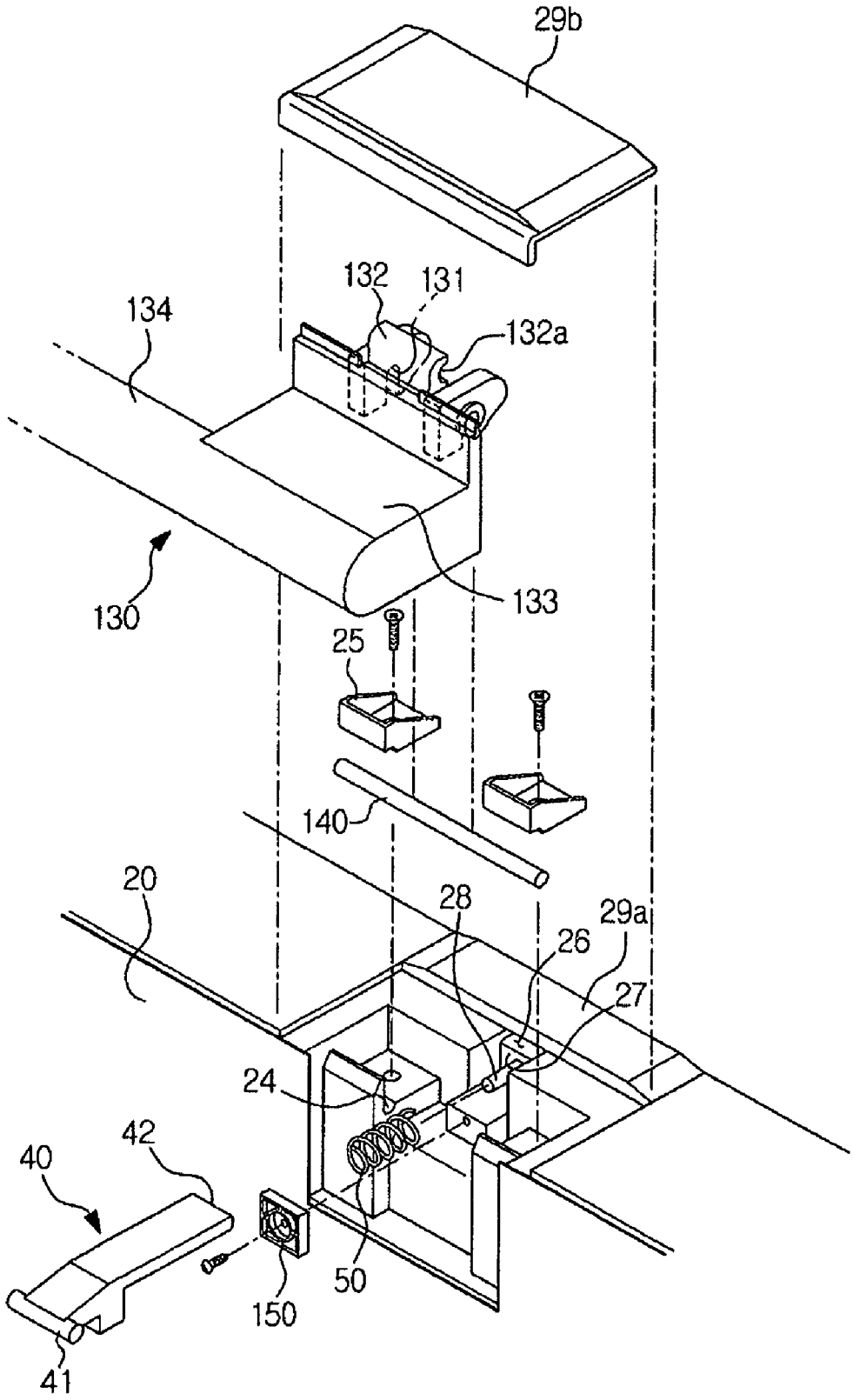
FIG. 6 illustrates an exploded perspective view showing a door and a handle of a refrigerator according to a second embodiment.
Figure 7:
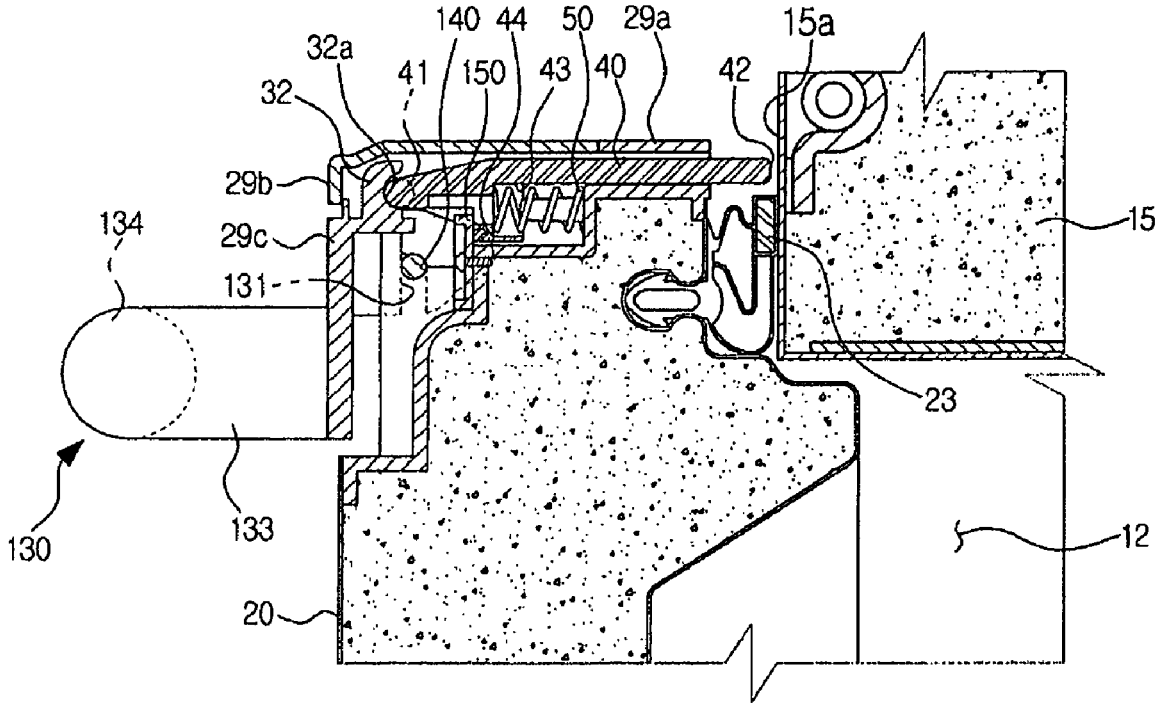
FIG. 7 illustrates a cross-sectional view of essential parts showing a closed state of the door of the refrigerator according to the second embodiment.

FIG. 6 illustrates an exploded perspective view showing a door and a handle of the refrigerator according to the second embodiment. FIG. 7 illustrates a cross-sectional view of essential parts showing a closed state of the door of the refrigerator according to the second embodiment.

As shown in FIGS. 6 and 7, the refrigerator according to the second embodiment includes the third door 20 which slidably opens and closes the lower storage compartment 12, a handle 130 which is horizontally disposed at the upper portion of the third door 20, rotation shafts 140 which form a rotational axis to enable vertical rotation of the handle 130 and a plurality of push members 40 which move to advanced positions from retreated positions as the handle 130 is rotated upward to separate the third door 20 from the main body 10.

The handle 130 is disposed at the upper boundary of the third door 20 to be substantially parallel thereto such that the user can grip the handle 130 to move the third door 20 forward and backward. The handle 130 includes a grip rod 134 which is gripped by the user, a pair of pressing portions 132 which are disposed at opposite sides of the grip rod 134 to move a pair of the push members 40 to advanced positions, levers 133 which connect the grip rod 134 to the pressing portions 132, and coupling grooves 131 which couple the handle 130 with the rotation shafts 140.

The grip rod 134 is formed corresponding to the width of the third door 20 to have a length substantially equal to or slightly smaller than the width of the third door 20 such that the user can easily grip the grip rod 134.

A pair of the levers 133 is formed at opposite ends of the grip rod 134. When the user rotates the grip rod 134 upward, a pair of the levers 133 formed as a single body with the grip rod 134 is rotated around the rotation shafts 140 to advance the pressing portions 132.

The pressing portions 132 are rotated (clockwise in the drawing) as the levers 133 are rotated upward, thereby advancing the push members 40. The pressing portions 132 have arc-shaped pressing surfaces 132*a* at portions in contact with the push members 40. The pressing portions 132 press first contact portions 41 of the push members 40 to advance the push members 40.

The coupling grooves 131 couple the handle 130 to the rotation shafts 140 such that the handle 130 can rotate with respect to the rotation shafts 140. The coupling grooves 131 have grooves to which the rotation shafts 140 are inserted from the lower side. The coupling grooves 131 are coupled to the rotation shafts 140 by moving the handle 130 downward with respect to the rotation shafts 140.

Seating grooves 24 are formed on the upper surface of the third door 20 corresponding to the rotation shafts 140. Anti-separation pieces 25 are coupled to the seating grooves 24 to cover the rotation shafts 140, thereby firmly fixing the rotation shafts 140.

Accordingly, when the user rotates the grip rod 134 upward, a pair of the levers 133 formed as a single body with the grip rod 134 is rotated around the rotation shafts 140 to advance the pressing portions 132. When the user releases the grip rod 134, that is, when an external force exerted on the handle 130 is removed, the handle 130 is rotated downward around the rotation shafts 140 due to the weight of the grip rod 134 and the levers 133. Accordingly, the handle 130 is restored to its original state.

In the same way as the push members of the first embodiment, the push members 40 include first and second contact portions 41 and 42 formed at opposite ends thereof, and edge portions 44 which are formed to be protruded downward and have the receiving portions 43 defined therein.

Further, the elastic members 50 are disposed between the push members 40 and the third door 20 to provide an elastic force to the push members 40 such that the second contact portions 42 of the push members 40 can be restored to a state in which the second contact portions 42 are spaced from the main body 10.

The elastic members 50 are formed in a coil spring shape and arranged in a space between the push members 40 and the third door 20.

The guides 28 are protrudingly formed on the step portions 27 to guide smooth contraction and restoration of the elastic members 50.

Further, in the second embodiment, stoppers 150 are provided to prevent the elastic members 50 from being separated from the guides 28 in the assembly. The stoppers 150 are coupled through screws and the guides 28 are inserted into the elastic members 50. Accordingly, one end of each of the elastic members 50 is supported by the step portions 27 and the other end of each of the elastic members 50 is supported by the stoppers 150, thereby preventing the separation of the elastic members 50.

Thus, it is possible to prevent reduction of workability due to inconvenience occurring when the elastic members are manually fixed in order to prevent the frequent separation of the elastic members in the assembly.

Next, an assembly process of the push members and the handle included in the refrigerator of the second embodiment of the present invention will be described.

First, the stoppers 150 are coupled through screws and the guides 28 are inserted into the elastic members 50 such that the opposite ends of the elastic members 50 are supported by the step portions 27 and the stoppers 150.

Then, the elastic members 50 are contracted by pressing one end of the elastic members 50 supported by the stoppers 150 such that separation spaces are formed between the stoppers 150 and leading ends of the guides 28. The edge portions 44 of the push members 40 are inserted into the separation spaces, and one end of each of the elastic members 50 is received in the receiving portions 43 of the push members 40. In this case, the second contact portions 42 of the push members 40 slide into the grooves 26 to fix the push members 40.

Then, after the rotation shafts 140 are placed on the seating grooves 24, the rotation shafts 140 are fixed using the anti-separation pieces 25. Then, the coupling grooves 131 are coupled to the rotation shafts 140 such that the pressing surfaces 132*a* of the pressing portions 132 of the handle 130 are adjacent to the first contact portions 41 of the push members 40, thereby completing the assembly of the handle 130.

Then, the second covers 29*b*, which close assembly portions of the push members 40, the elastic members 50 and the handle 130, are assembled to the upper surface of the third door 20.

Although embodiments have been shown and described, it would be appreciated by those skilled in the art that changes may be made in this embodiment without departing from the principles and spirit of the invention, the scope of which is defined in the claims and their equivalents.

What is claimed is:

1. A refrigerator comprising:

a main body having an upper storage compartment and a lower storage compartment;

a sliding door to open and close the lower storage compartment;

a handle disposed at an upper portion of the sliding door to be vertically rotatable, the handle including a grip rod having a length substantially corresponding to a width of the sliding door, and a pair of levers extending from opposite ends of the grip rod, respectively;

a pair of push members disposed at an upper end of the sliding door at positions corresponding to the levers, respectively, to move forward and backward, the push members moving in accordance with upward rotation of the handle to space the sliding door from the main body;

rotation shafts to rotatably support the handle;

seating grooves disposed at the upper end of the sliding door at positions corresponding to opposite ends of each of the rotation shafts, respectively, the seating grooves being opened upward to receive the opposite ends of each of the rotation shafts, so as to support the rotation shafts;

anti-separation pieces coupled at the upper end of the sliding door to cover opened portions of the seating grooves, so as to prevent each of the rotation shafts from being separated from the seating grooves; and coupling grooves extending from the levers to be fitted to said rotation shafts, respectively.

2. The refrigerator according to claim 1, further comprising:

elastic members to return the push members to an original position when an external force is removed from the handle.

3. The refrigerator according to claim 2, wherein a step portion is formed at the upper surface of the sliding door to support a first end of each of the elastic members.

4. The refrigerator according to claim 3, wherein at least one of the push members includes a receiving portion receiving and supporting a second end of at least one of the elastic members.

5. The refrigerator according to claim 1, wherein the handle moves the push members forward when the handle is rotated upward by an external force, and the handle is rotated downward by a weight of the handle when the external force is removed from the handle.

6. A refrigerator comprising:

a main body having an upper storage compartment and a lower storage compartment;

a sliding door to open and close the lower storage compartment;

a handle disposed at an upper portion of the sliding door to be vertically rotatable, the handle including a grip rod disposed at the upper portion of the sliding door while extending horizontally, and a pair of levers at opposite ends of the grip rod, respectively;

a pair of push members disposed at an upper end of the sliding door at positions corresponding to the levers, respectively, to move forward and backward, the push members moving in accordance with upward rotation of the handle to space the sliding door from the main body;

a pair of pressing portions extending from the levers to engage the push members, respectively;

rotation shafts to rotatably support the handle;

seating grooves disposed at the upper end of the sliding door at positions corresponding to opposite ends of each of the rotation shafts, respectively, the seating grooves being opened upward to receive the opposite ends of each of the rotation shafts, so as to support the rotation shafts;

anti-separation pieces coupled at the upper end of the sliding door to cover opened portions of the seating grooves, so as to prevent each of the rotation shafts from being separated from the seating grooves; and coupling grooves extending from the levers to be fitted to rotation shafts, respectively, wherein the push members press against the main body in accordance with the upward rotation of the handle, thereby spacing the sliding door from the main body, and wherein the handle is returned to an original position as the handle is rotated downward by a weight of the handle after the upward rotation of the handle.

7. The refrigerator according to claim 6, further comprising an elastic member disposed between at least one of the push members and the door to restore the at least one push member to a state in which the at least one push member is spaced from the main body.

8. The refrigerator according to claim 7, wherein a step portion is formed at an upper surface of the door to support a first end of the elastic member, and said at least one of the push members includes a receiving portion receiving and supporting a second end of the elastic member.

9. The refrigerator according to claim 8, wherein a guide is disposed between the step portion and the receiving portion to guide smooth contraction and restoration of the elastic member.

10. The refrigerator according to claim 9, further comprising a stopper disposed between the elastic member and the push member to prevent the elastic member from being separated from the guide.

11. The refrigerator according to claim 6, wherein the rotation shafts are formed as a single body with the handle.

* * * * *

UNITED STATES PATENT AND TRADEMARK OFFICE

CERTIFICATE OF CORRECTION

PATENT NO. : 8,025,349 B2
APPLICATION NO. : 12/320833
DATED : September 27, 2011
INVENTOR(S) : Jae Hoon Lim et al.

It is certified that error appears in the above-identified patent and that said Letters Patent is hereby corrected as shown below:

Title Page Column 2 (Foreign Patent Documents), Line 2, Below

"EP 1174668 * 1/2002"

delete "EP 1175668 * 1/2002".

Signed and Sealed this
Sixth Day of March, 2012

David J. Kappos

David J. Kappos
*Director of the United States Patent and Trademark Office*